United States Patent [19]

Unger

[11] Patent Number: 4,858,267

[45] Date of Patent: Aug. 22, 1989

[54] APPARATUS FOR WET CLEANING IN PARTICULAR WINDOW PANES

[76] Inventor: Henry M. Unger, 24, Sunset Dr., Weston, Conn. 06880

[21] Appl. No.: 169,909

[22] Filed: Mar. 18, 1988

[30] Foreign Application Priority Data

May 25, 1987 [DE] Fed. Rep. of Germany ..... 3717573

[51] Int. Cl.[4] ..... A47L 1/08

[52] U.S. Cl. ..... 15/220 R; 15/147 A; 15/147 B; 15/228; 15/235; 15/232

[58] Field of Search ..... 15/220 R, 104.8, 147 B, 15/232, 235, 244.4, 228, 244.2, 220 A, 221, 224

[56] References Cited

U.S. PATENT DOCUMENTS

| | | | |
|---|---|---|---|
| 1,310,910 | 7/1919 | Hodschar | 15/235 |
| 1,866,505 | 7/1932 | Kootz | 15/229.7 |
| 2,564,031 | 8/1951 | Rich | 15/235 |
| 2,638,616 | 5/1953 | Fatland | 15/147 A |
| 2,756,449 | 7/1956 | Dewey | 15/235 |
| 2,984,854 | 5/1961 | Johnson | 15/235 |
| 3,015,834 | 1/1962 | Marrinson et al. | 15/228 |
| 3,166,775 | 1/1965 | Cushman | 15/228 |
| 4,114,223 | 9/1978 | Buchanan | 15/228 |
| 4,766,632 | 8/1988 | Murray | 15/147 B |

FOREIGN PATENT DOCUMENTS

| | | | |
|---|---|---|---|
| 3139245 | 4/1983 | Fed. Rep. of Germany | 15/228 |
| 568953 | 4/1924 | France | 15/232 |
| 627189 | 9/1927 | France | 15/114 |

OTHER PUBLICATIONS

French Pat. No. 568,953 includes only 1 page of the reference. This page shows FIGS. 1-4. No Specification Attached.

*Primary Examiner*—Stephen Marcus
*Assistant Examiner*—Christine A. Peterson
*Attorney, Agent, or Firm*—John C. Smith, Jr.

[57] ABSTRACT

An apparatus for wet cleaning in particular window panes includes an elongated carrier for a removable, fur-like cleaning body surrounding said carrier and a shaft-like handle being mounted at said carrier rectangularly thereto. The cleaning body has an outer cover with a longitudinal slot by means of which it can be applied to the carrier. This apparatus is superior as compared with the known apparatuses in that a holder is secured to the front end of the handle which has at each of its ends short threaded pins, two elongated arms being screwed onto the threaded pins which forms, together with the holder, the carrier for the cleaning body which is open at both ends. The longitudinal slot in the outer cover of the cleaning body is associated with the holder and comprises a length corresponding to that of the holder together with a threaded pin.

15 Claims, 1 Drawing Sheet

APPARATUS FOR WET CLEANING IN PARTICULAR WINDOW PANES

BACKGROUND OF THE INVENTION

This invention relates to an apparatus for wet cleaning in particular window panes including an elongated carried for a removable fur-like cleaning body surrounding said carrier, and a shaft-like handle being mounted at said carrier rectangularly thereto, said cleaning body having an outer cover with a longitudinal slot by means of which it can be applied to the carrier.

Apparatuses of this kind are known. They have, however, substantial disadvantages. The cleaning of the window panes becomes difficulty when the carrier is longer than the width of the window pane. The apparatus can further not be used for cleaning the bottom part of the window pane when the window reaches up to or nearly up to the floor and in front of the window there is arranged, for example, a radiator or the like. For the purpose of cleaning the bottom part of the window pane the apparatus must be guided below the radiator and the cleaning body must be set on the window pane in an up-end manner. This is, however, not possible in the case of a radiator consisting of vertically arranged ribs, due to the connection between the ribs near the floor. The cleaning body must further have a slot extending at least over half its length in order to be able to insert the carrier of the cleaning apparatus into the cleaning body. For securing the cleaning body to the carrier, the longitudinal edges of the slot must be held together, e.g. by means of snap-button fasteners.

SUMMARY OF THE INVENTION

It is an object of the present invention to avoid the above-mentioned disadvantages and to improve an apparatus of the kind described at the beginning so that it can be used easily independently of the width of the window pane to be cleaned and also at hardly accessible parts of the window pane. It is a further object of the invention to simplify the cleaning body as regards its mounting on the carrier of the apparatus.

To attain this object, the present invention provides an apparatus for wet cleaning in particular window panes, including an elongated carrier for a removable fur-like cleaning body surrounding said carrier, and a shaft-like handle being mounted at said carrier rectangularly thereto, said cleaning body having an outer cover with a longitudinal slot by means of which it can be applied to the carrier, wherein a holder is secured to the front end of the handle, said holder having at each of its ends short threaded pins, two elongated arms being screwed onto said threaded pins which form, together with the holder, the carrier for the cleaning body being open at both ends, and the longitudinal slot provided in the outer cover of the cleaning body is associated with the holder and comprises a length corresponding to that of the holder together with a threaded pin.

The apparatus is inserted into the cleaning body with the holder and one of the threaded pins and then shifted in the cleaning body until the handle abuts against the one end of the longitudinal slot, thereafter, the other threaded pin being inserted through the longitudinal slot into the cleaning body and subsequently the apparatus is shifted in the direction towards the other end of the longitudinal slot to such an extent that the holder is placed approximately in the center of the longitudinal slot. Thereafter, the arms of the apparatus are inserted innto the cleaning body and screwed onto the threaded pins. The cleaning body is thereby securely mounted on the arms without the necessity of holding together the longitudinal edges of the longitudinal slot, e.g. by means of snapbutton fasteners.

Due to the replaceability of the arms or by omitting one of the arms, the apparatus can be adapted to the requirements occurring when cleaning a window pane. For cleaning a window pane, the apparatus may be provided with arms corresponding to the width of the window pane. This facilitates a cleaning thereof substantially. Further, the apparatus makes it possible to clean the window pane in the vicinity of the floor also in the case that in front of the window pane and close thereto there is arranged a radiator consisting of vertically arranged ribs so that, due to the floor-side connections of the ribs it is not possible to reach behind the radiator in order to apply both arms of the apparatus to the window pane. That part of the cleaning body which is not used in this event is bent over in such a manner that it is held together with the handle of the apparatus. It thus does not hinder the cleaning process.

In an advantageous embodiment of the invention the cleaning body projects, at least with one of its ends, beyond the corresponding elongated arm and a wire or the like is embedded in the cleaning body which reaches up to the free end of the projecting part of the cleaning body.

In order to clean very dirty portions of the window pane in an easy way, the projecting part of the cleaning body is bent over, this part being held in its position by means of the wire. The cleaning body is now applied to the very dirty portions of the window pane with its bent over part so that it becomes easier to clean the window pane in such a manner than with the lateral part of the cleaning body. The bent over part of the cleaning body may be brought, together with the wire, in its initial position when it is not to be used.

In a further advantageous embodiment of the invention longitudinally extending, groove-shaped recesses are provided in the elongated arms and the holder.

When the apparatus is dipped into the cleaning water, the groove-shaped recesses fill with cleaning water so that cleaning water is stored beside the cleaning body.

BRIEF DESCRIPTION OF THE DRAWING

An embodiment of the invention will be described by way of example and with reference to the accompanying drawing in which.

DESCRIPTION OF THE PREFERRED EMBODIMENT

Figure 4:
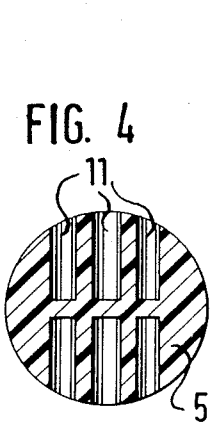
FIG. 4 is a section on the line B—B in FIG. 2.
Figure 3:
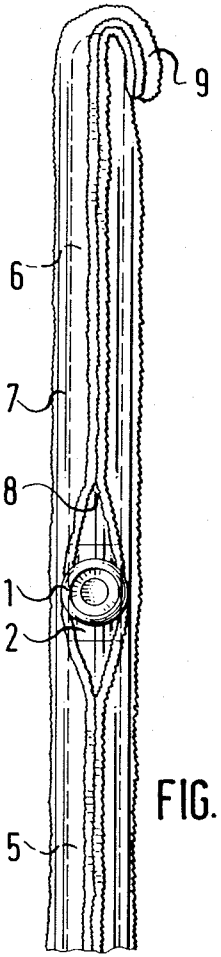
FIG. 3 is a side elevational view, in the direction of arrow A in FIG. 1.
Figure 2:
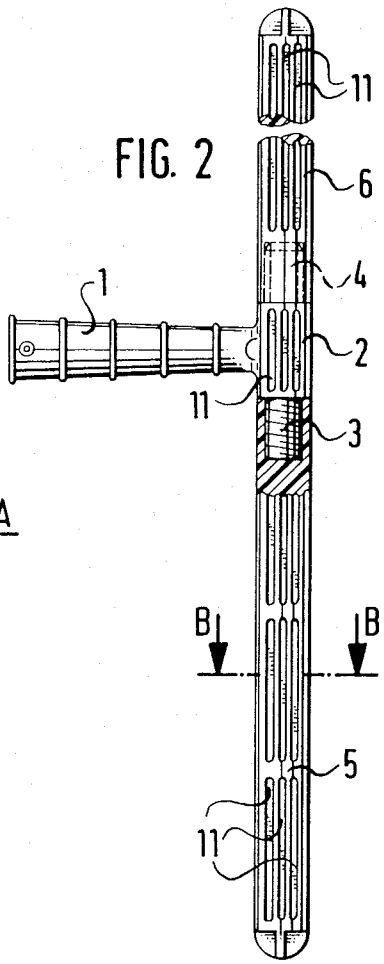
FIG. 2 is an elevational view of the apparatus, partly in section, without cleaning body.
Figure 1:
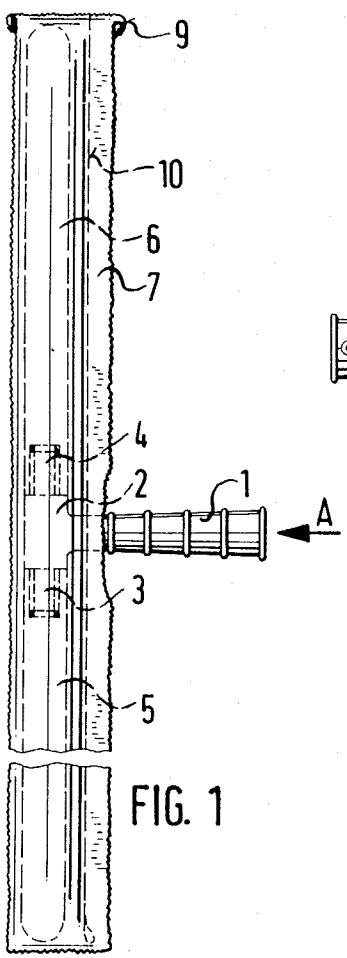
FIG. 1 is an elevational view of an apparatus for wet cleaning in particular window panes with a cleaning body.

FIGS. 1 to 4 show an apparatus for wet cleaning window panes having a shaft-like handle 1 at the front end of which a holder 2 is arranged extending transversely to the handle 1. The handle 1 and the holder 2 are integrally produced from plastic material. The holder 2 has at both of its ends threaded pins 3 and 4 which are integral with the holder 2. Two arms 5 and 6, preferably consisting of plastic material, are screwable onto the threaded pins 3 and 4 and serve, together with the holder 2, as a carrier for a fur-like hollow cleaning body 7 which is open at its ends. The outer cover of the cleaning body 7 has a longitudinal slot 8 corresponding, as regards its length, to the holder 2 with a threaded pin 3 or 4 and the shaftlike handle 1 extends from said slot 8. The cleaning body 7 has at one of its ends an extension 9 with which it projects beyond the free end of the arm 6 and which is bent over so that the free end of the arm 6 is covered. In the cleaning body 7 there is embedded a wire 10 or the like which reaches up to the free end of the extension 9 and which, due to its flexibility, hold the extension 9 in its bent position. The arms 5 and 6 and the holder 2 have at their outer sides longitudinally extending, groove-shaped recesses 11 which are filled with cleaning water when the cleaning body 7 is dipped into the water.

The invention may be embodied in other specific forms without departing from the spirit or essential characteristics thereof. The embodiment is therefore to be considered in all respect as illustrative and not restrictive.

What is claimed is:

1. Apparatus for wet cleaning window panes comprising:

(a) an elongated handle;

(b) an elongated, rigid holder at one end of said handle, said handle joining said holder intermediate opposite ends of said holder such that said holder is transverse to said handle;

(c) two linear, elongated, rigid arms, a plurality of recesses being located in the surface of each of said elongated arms for retaining cleaning water after said tubular cleaning member surrounding said arms has been immersed in water;

(d) cooperating means, at opposite ends of said holder and one end of each of said arms, respectively, for detachably securing said one end of each of said arms to one of said opposite ends, respectively, of said holder such that said arms extend from opposite ends, respectively, of said holder transversely to said handle; and (e) a flexible, elongated, water-permeable, tubular cleaning member entirely closed except for a longitudinally extending slit therein intermediate the opposite ends thereof, said slit in said tubular cleaning member being only of sufficient length to permit one end of said holder, with said cooperating securing means at said one end thereof, to be inserted into said cleaning member through said slit adjacent one end of said slit while the opposite end of said holder, with said cooperating securing means at said opposite end thereof, is in said cleaning member and a portion of said handle extending through said slit is in contact with said opposite end of said slit;

(f) whereby said cleaning member is retained in place surrounding said holder and two elongated arms secured thereto when said arms are secured in place at opposite ends, respectively, of said holder after said holder and arms are inserted in said cleaning member through said slit.

2. Apparatus according to claim 1 wherein said cooperating means for detachably securing said one end of each of said arms to said opposite ends, respectively, of said holder comprises externally threaded pins on the opposite ends of said holder and complementary internally threaded recesses in one end of each of said arms.

3. Apparatus according to claim 1 wherein a plurality of recesses are provided in the surface of said holder for retaining cleaning water after said cleaning member surrounding said holder has been immersed in water.

4. Apparatus according to claim 1 wherein said tubular cleaning member has a fur-like surface.

5. Apparatus according to claim 1 wherein said tubular cleaning member projects beyond the end of at least one of said elongated arms and said cleaning member comprises a flexible elongated wire-like member embedded therein along the length of said cleaning member for supporting the end of said cleaning member projecting beyond said at least one elongated arm in any predetermined position.

6. Apparatus for wet cleaning window panes comprising:

(a) an elongated handle;

(b) an elongated, rigid holder at one end of said handle, said handle joining said holder intermediate opposite ends of said holder such that said holder is transverse to said handle;

(c) two linear, elongated, rigid arms;

(d) cooperating means, at opposite ends of said holder and one end of each of said arms, respectively, for detachably securing said one end of each of said arms to one of said opposite ends, respectively, of said holder such that said arms extend from opposite ends, respectively, of said holder transversely to said handle; and (e) a flexible, elongated, water-permeable, tubular cleaning member having a length longer than the combined length of said holder and said arms secured thereto and being entirely closed except for a longitudinally extending slit therein intermediate the opposite ends thereof, said slit in said tubular cleaning member being only of sufficient length to permit one end of said holder, with said cooperating securing means at said one end thereof, to be inserted into said cleaning member through said slit adjacent one end of said slit while the opposite end of said holder, with said cooperating securing means at said opposite end thereof, is in said cleaning member and a portion of said handle extending through said slit is in contact with said opposite end of said slit, said tubular cleaning member projecting beyond the end of at least one of said elongated arms and comprising a flexible elongated wire-like member embedded therein along the length of said cleaning member for supporting the end of said cleaning member projecting beyond said at least one elongated arm in any predetermined position;

(f) whereby said cleaning member is retained in place surrounding said holder and two elongated arms secured thereto when said arms are secured in place at opposite ends, respectively, of said holder after said holder and arms are inserted in said cleaning member through said slit.

7. Apparatus for wet cleaning window panes comprising:

(a) an elongated handle;

(b) an elongated, rigid holder at one end of said handle, said handle joining said holder intermediate opposite ends of said holder such that said holder is transverse to said handle;

(c) two linear, elongated, rigid arms;

(d) cooperating means, at opposite ends of said holder and one end of each of said arms, respectively, for detachably and rigidly securing said one end of each of said arms to one of said opposite ends, respectively, of said holder such that when said arms are attached to said holder, said arms extend rigidly from opposite ends, respectively, of said holder transversely to said handle; and (e) a flexible, elongated, water-permeable, tubular cleaning member surrounding said holder and arms and being entirely closed except for a longitudinal, narrow slit therein intermediate the opposite ends thereof and extending lengthwise of said tubular cleaning member, said slit in said tubular cleaning member being only of sufficient length to permit one end of said holder, with said cooperating securing means at said one end thereof, to be inserted into said cleaning member through said slit adjacent one end of said slit while the opposite end of said holder, with said cooperating securing means at said opposite end thereof, is in said cleaning member and a portion of said handle extending through said slit is in contact with said opposite end of said slit;

(f) whereby said cleaning member is retained in place surrounding said holder and two elongated arms secured thereto when said arms are secured in place at opposite ends, respectively, of said holder after said holder and arms are inserted in said cleaning member through said slit.

8. Apparatus according to claim 7 wherein said cooperating means for detachably securing said one end of each of said arms to said opposite end, respectively, of said holder to form a joint at each of said opposite ends of said holder, comprises, at each said joint, an externally threaded pin projecting from one of said holder and said arm and a complementary internally threaded recess in the other of said holder and said arm, and wherein said tubular cleaning member has a length corresponding to at least the combined length of said holder and said arms and at least one of said externally threaded pins.

9. Apparatus according to claim 7 wherein said elongated arms each have an outer surface, said tubular cleaning member has an exterior surface for contacting said windowpanes and an interior surface contacting said outer surface of each of said arms and a plurality of recesses are provieed in said outer surface of each of said elongated arms at opposite sides thereof and spaced from the free end thereof for receiving and retaining cleaning water when said tubular cleaning member surrounding said arms is immmersed in water and for supplying said retained water to opposite sides of said cleaning member during use.

10. Apparatus according to claim 9 wherein said holder has an outer surface, said interior surface of said cleaning member contacts said outer surface of said holder and a plurality of recesses are provided in said outer surface of said holder at opposite sides thereof for receiving and retaining cleaning water when said cleaning member surrounding said holder is immersed in water and for supplying said retained water to opposite sides of said cleaning member during use.

11. Apparatus according to claim 9 wherein said plurality of recesses comprise a plurality of elongated recesses in said outer surfaces of said elongated arms at opposite sides of said arms, the opposite ends of each of said recesses being closed, for supplying cleaning water to opposite sides of said cleaning member during use.

12. Apparatus according to claim 10 wherein said plurality of recesses comprise a plurality of elongated recesses in said outer surfaces of said arms and said holder at opposite sides thereof, the opposite ends of each of said recesses being closed, for supplying cleaning water to opposite sides of said cleaning member during use.

13. Apparauts for wet cleaning windowpanes comprising:

(a) an elongated handle;

(b) an elongated carrier at one end of said handle, said handle joining said carrier intermediate opposite ends of said carrier such that said elongated carrier is transverse to said handle, said carrier having an outer surface surrounding said carrier intermediate said opposite ends thereof; and (c) a flexible, elongated, water-permeable, tubular cleaning member surrounding said carrier, said cleaning member having an exterior surface for contacting said windowpanes and an interior surface contacting said outer surface of said carrier;

(d) said carrier having a plurality of recesses in a substantial portion of said outer surface thereof for receiving and retaining cleaning water when said tubular cleaning member surrounding said elongated carrier is immersed in water and for supplying said retained water to said cleaning member during use, said recesses being spaced from said opposite ends of said carrier.

14. Apparatus according to claim 13 wherein said plurality of recesses comprise a plurality of elongated recesses in said outer surface of said carrier at opposite sides of said carrier for supplying cleaning water to opposite sides of said cleaning member during use, the opposite ends of each of said recesses being closed.

15. Apparatus according to claim 14 wherein said outer surface of said elongated carrier is a cylindrical surface intermediate opposite ends thereof, said plurality of elongated recesses being in said cylindrical surface at opposite sides of said carrier for supplying cleaning water to opposite sides of said cleaning member during use.

* * * * *